United States Patent [19]

Lefebvre et al.

[11] 4,076,070

[45] Feb. 28, 1978

[54] LOW-PRESSURE DIECASTING MACHINE

[75] Inventors: Jean Lefebvre; Jean-Claude Pichouron, both of Boulogne-Billancourt, France

[73] Assignees: Regie Nationale des Usines Renault, Boulogne-Billancourt; Automobiles Peugeot, Paris, both of France

[21] Appl. No.: 618,485

[22] Filed: Oct. 1, 1975

[30] Foreign Application Priority Data

Oct. 9, 1974 France ..... 74.33918

[51] Int. Cl.[2] ..... B22D 17/00; B22D 27/14

[52] U.S. Cl. ..... 164/303; 164/119

[58] Field of Search ..... 164/284, 285, 113, 119, 164/120, 363, 369, 291, 292, 298, 304, 306, 307, 308, 309, 362, 364, 303; 249/105, 107, 109, 110

[56] References Cited

U.S. PATENT DOCUMENTS

| | | | |
|---|---|---|---|
| 393,349 | 11/1888 | Ayres | 164/363 |
| 3,282,551 | 11/1966 | Neff | 249/109 |
| 3,299,480 | 1/1967 | Woodburn | 164/363 |
| 3,599,708 | 8/1971 | Suzuki | 249/109 X |
| 3,672,807 | 6/1972 | Genz | 249/109 X |
| 3,698,471 | 10/1972 | Chatourel | 164/113 X |
| 3,779,304 | 12/1973 | Miki | 164/113 X |

*Primary Examiner*—Francis S. Husar
*Assistant Examiner*—John S. Brown
*Attorney, Agent, or Firm*—Fleit & Jacobson

[57] ABSTRACT

The invention relates to an automatic low-pressure diecasting machine, notably for mass-production equipments. The casting takes place through a heat-insulated distribution chamber thermally insulated from the lower portion of the mould structure and delivering the molten metal directly to the mould impression or impressions through a series of substantially vertical feed metal inlet passages formed through the mould bottom. The distribution chamber, of relatively simple design, extends substantially over the entire area of the lower mould impression which requires the presence of such feed metal inlet passages. This machine is intended more particularly for light-alloy castings.

3 Claims, 3 Drawing Figures

LOW-PRESSURE DIECASTING MACHINE

Figure 1:
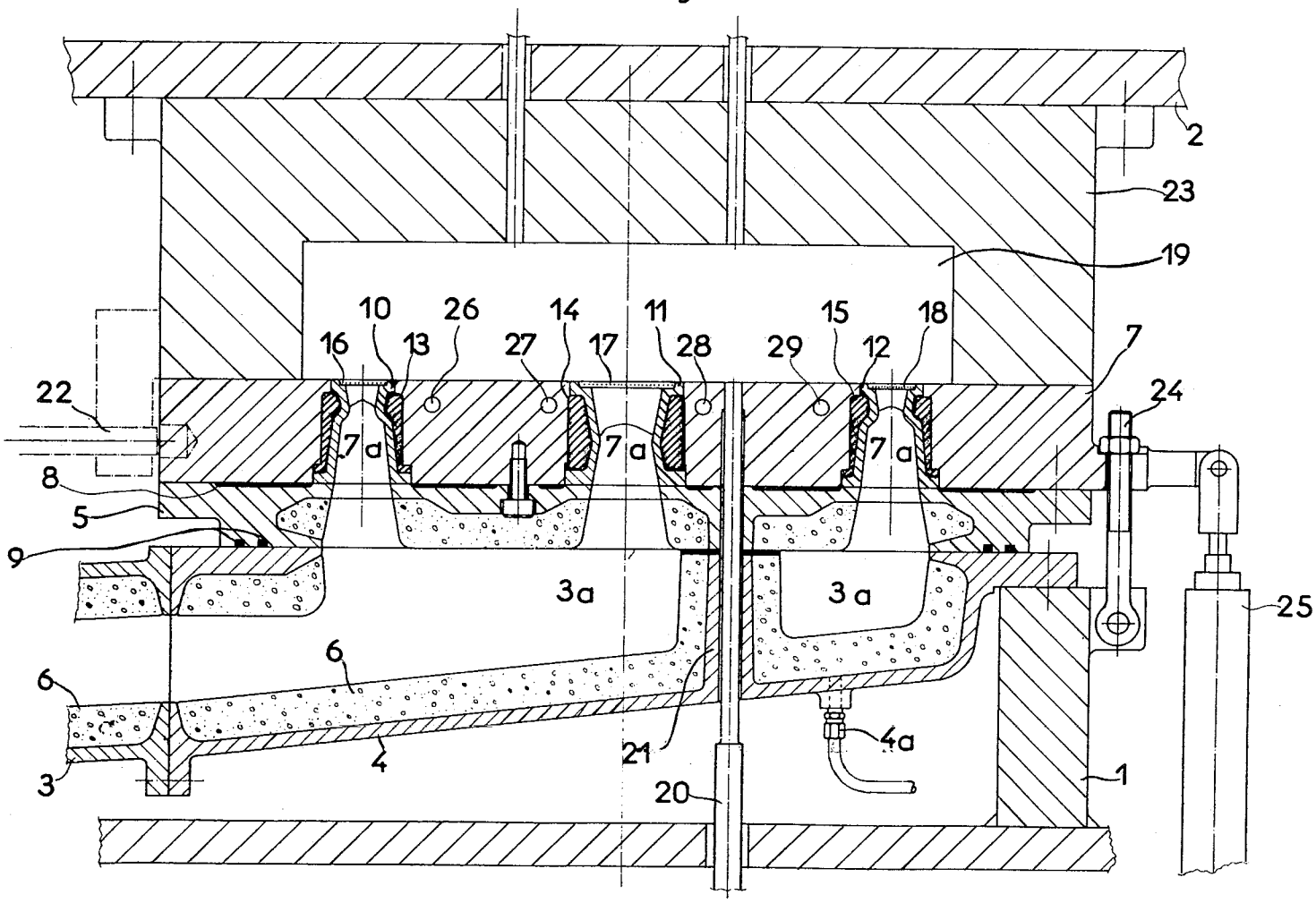

This invention relates in general to the automatic production of die-castings according to the so-called low-pressure method, and has specific reference to a feed metal inlet system applicable to automatic low-pressure die-casting machines.

It is known, in the production of castings having a relatively large surface area through this low-pressure technique, to cast the feed metal by causing the molten metal to penetrate into the moulding impression or cavity at one or a plurality of points relatively close to the metal supply or delivery points, thus localizing the possibilities of feeding narrow or recessed spots. It is therefore rather difficult, under these circumstances, to warrant an all-round satisfactory, sound casting quality while preserving a high production rate, due to the necessity of diffusing the heat concentrated at the thus created hot spots (risks of shrinkage porosity). Moreover, the rather limited section of the feed metal inlet system requires in most cases a reduced mould filling rate involving in many cases misruns or weak castings due to premature solidification.

It is the primary object of the present invention to provide a greater number of feed metal inlets for such castings having a relatively large surface area in order to remove the above-listed inconveniences of prior art devices, i.e.:

improving the possibilities of feeding recessed or narrow spots throughout the casting, increasing the volumetric capacity and production rate of metal moulds, and affording the filling flow rates consistent with each type of casting.

With this end in view and according to a specific object of the present invention, the molten metal is fed from beneath through the bottom of the lower mould half (uphill casting) via a heat-insulated distribution chamber covering the entire surface of the mould impressions or casting cavities. The heat insulation may consist of any known and suitable material capable of preventing the diffusion of heat, such as, for instance, refractory felts or cellular concrete.

The casting metal may be introduced into said distribution chamber either laterally or from beneath according to the type of casting machine implemented.

Bosses are provided in said chamber to permit the passage of ejectors, if necessary, the position of said bosses being of course consistent with the specific shape of the casting. The chamber is connected through vertical feed metal inlets to the mould cavity wherever this appears to be necessary for obtaining satisfactory casting conditions.

It is another object of this invention to facilitate the access to the distribution chamber through a horizontal joint plane whereby the complete chamber surface can be uncovered.

To this end, there is provided a suitable surface joint along the periphery of the chamber, in conjunction with flexible sealing braids between the upper and lower portions of the chamber.

The upper portion of the chamber may, if desired, be rigid with the lower portion of the mould cavity or impression. Thus, access to the chamber is obtained by simply disengaging this lower portion of the mould cavity or impression from the mould structure, and fastening said lower mould cavity portion to the upper mould portion so that the complete mould together with the upper portion of the casting chamber can be raised by using the fluid-actuated cylinder of the machine.

For the same purpose one may also cause the lower portion of the mould cavity or impression to move in relation to the lower portion of the chamber by means of suitable fluid-actuated cylinders.

A heat-resistant seal is provided between the upper portion of the chamber and the lower portion of the mould impression. This arrangement may be completed if desired by providing cooling means in the lower mould impression.

The metal injection orifices consist of low thermal inertia metal members insulated from the lower portion of the mould impression by means of heat-insulating means in order to keep the metal in its molten state during the supply thereof to the recessed spots or portions of the mould impression and also to prevent any impairment of the thermal equilibrium of the mould.

The present invention is applicable to all castings made under low-pressure conditions in an integral metal mound (die-casting) or in compound moulds (sand-cum-metal casting), as well as in moulds consisting entirely of chemically agglomerated sand.

More particularly, it is the essential object of the present invention to provide a machine for automatically die-casting foundry parts under low-pressure conditions, wherein a furnace containing molten metal is subjected to a gaseous pressure causing the metal to be forced into casting moulds through feed metal inlets opening into the lower portions of the moulds, said means being characterised in that the metal is cast through a distribution chamber heat-insulated in relation to the lower portion of the assembly and feeding directly the mould cavity or cavities through a plurality of vertical metal feed inlets disposed through the mould bottom.

The casting machine according to this invention is also characterized in that the distribution chamber extends substantially beneath the entire areas of the lower impression or cavity of the casting mould requiring the presence of casting inlets having a simple contour to avoid undesired turbulences during the filling with molten metal.

The machine is further characterised in that the distribution chamber is formed between a lower portion and an upper portion separated by the joint plane whereby said portions can be taken apart to permit the access to the inside of said chamber.

The casting machine is characterised likewise in that the distribution chamber is provided with bosses extending thereacross to permit the mutual bearing engagement between the chamber forming sections, said bosses receiving therethrough spindle means for either facilitating the stripping of the solidified casting or forming holes through the casting.

The casting machine according to this invention is also characterised in that the upper portion of the chamber is rigidly assembled with the lower portion of the mould to that it can be lifted therewith, the lower portion of the chamber remaining rigid with the lower mould structure.

The casting machine according to this invention is further characterised in that the upper portion of the distribution chamber is heat insulated by suitable and known means from the lower portion of the mould.

In addition, the casting machine is characterised in that the feed metal inlets consist of sleeves of moderate heat inertia which are heat insulated from the mould by suitable and known heat insulating means.

The casting machine according to this invention is also characterised in that the casting hole comprises a throttled portion for localizing the casting solidification limit.

According to a preferred form of embodiment of this invention, the casting device is characterised in that the casting is a wheel of which the mould impression is adapted to be fed with molten metal simultaneously, at its central hub and at a plurality of peripheral points.

Finally, the casting machine is characterised in that the casting consists of an internal combustion engine cylinderhead of which the mould impression is adapted to be fed with molten metal simultaneously at its thicker portions or bosses.

Figure 2:
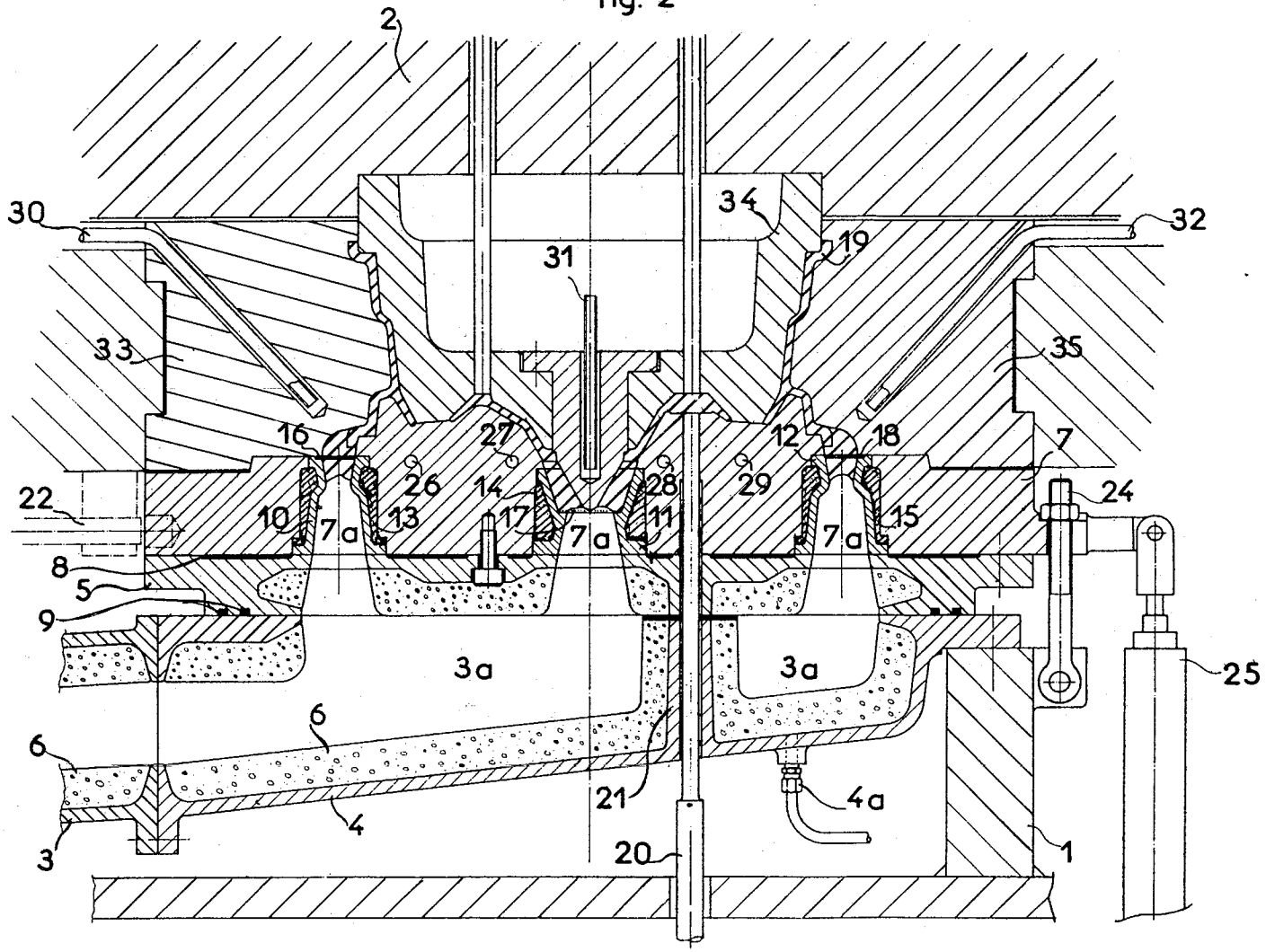
Figure 3:
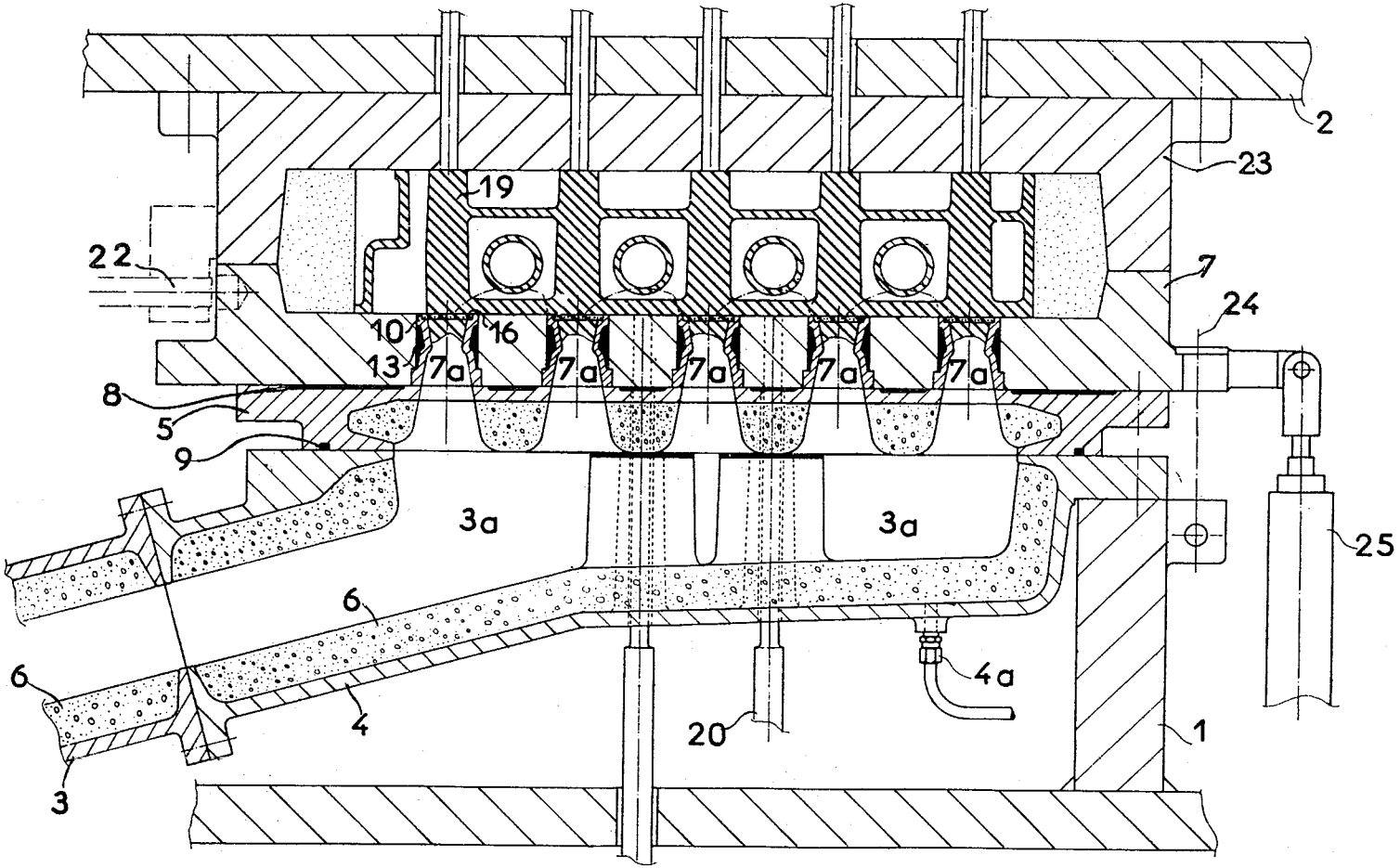

Other features and advantages of the present invention will be readily understood as the following description proceeds with reference to the attached drawing illustrating diagrammatically by way of example a few preferred forms of embodiment thereof. In the drawing:

FIG. 1 is a part-elevational, part-sectional view of the general arrangement of a machine for the mass production of castings of any design;

FIG. 2 is a part-elevational, part-sectional view of a typical machine according to this invention for die-casting a light-alloy automobile wheel, the machine being shown in its casting condition; and FIG. 3 is a part-elevational, part-sectional view of another typical embodiment of a low-pressure diecasting machine for the mass production of engine cylinderheads, the machine being shown in its casting condition.

Referring first to FIG. 1, the diecasting machine illustrated comprises a feed metal inlet system according to this invention for mass-producing any desired casting.

The mould proper, comprising a lower frame structure 1 and an upper frame structure 2, is mounted in a vertical press (not shown).

The lower mould structure 1 is stationary and rigid with the lower fixed structure of the press (not shown).

The upper mould structure 2 is movable and rigid with the upper plate of the press (not shown).

Molten metal is fed laterally or from beneath through a conduit 3 to a distribution chamber 3*a* comprising a lower portion or section 4 and an upper portion or section 5, said conduit 3 and distribution chamber 4, 5 being lined with heat insulating refractory material 6 for preventing on the one hand any abnormal heating of this chamber and on the other hand any dispersion of heat towards the machine structure, as this might cause an excessive heating thereof.

The lower portion of distribution chamber 3*a* is secured to the lower mould structure 1, and natural gas may be fed if necessary through an inlet pipe and nozzle assembly 4*a*.

The upper portion 5 of distribution chamber 3*a* is secured to the lower mould portion 7. These portions 5 and 7 are heat insulated from each other by means of a suitable sealing material 8.

The liquid metal is prevented from leaking through the joint between members 4 and 5 of distribution chamber 3*a* by the provision of flexible refractory seals 9 consisting for example of graphite-asbestos braid of a type suitable for such applications.

The feed metal injection orifices or passages 7*a* are located in the lower mould section 7. These injection orifices or passages 7*a* are formed centrally of metal sleeves 10, 11 and 12 having a relatively low thermal inertia and shaped to provide a throttled portion between oppositely-directed tapered sections, this throttled portion being selected to define the solidification limit of the casting. Moreover, these sleeve-like members 10, 11 and 12 are heat insulated from the mould impression 7 by means of a suitable lagging 13, 14, 15 of conventional type.

Filter means 16, 17 and 18 are disposed within the top of sleeves 10, 11 and 12 for preventing the ingress of slag and oxides into the overlapping castings 19.

Cooling circuits 26, 27, 28 and 29 are formed in the lower mould impression 7.

One or a plurality of ejectors 20 may extend through corresonding bosses 21 of the distribution chamber 3*a* for facilitating the removal of the casting from the lower mould impression 7 when stripping the casting.

On the other hand, the lower portion of mould impression 7 may be fastened through the means shown diagrammatically at 22 in the form of spindles to the upper mould impression 23.

Bolt means 24 secure the lower mould impression 7 and the upper chamber portion 5 to the lower chamber portion 4 for preserving the seal and joint tightness during the casting process.

Another arrangement designated diagrammatically by the reference numeral 25 may be used in lieu of the aforesaid means 22 and 24 and may consist for example of the eyebolt and cylinder fastening device illustrated.

Now the mode of operation of the machine will be described with reference to FIG. 1 of the drawing.

The liquid metal is forced into the heat-insulated distribution chamber 4, 5 through the heat-insulated conduit 3 connected in turn to the low-pressure casting furnace (not shown), for example of the type disclosed in the U.S. Pat. No. 3,727,674. The molten metal firstly fills up the distribution chamber 4, 5 and then rises through the heat-insulated metal inlets 10, 11, 12, the number of which is subordinate to the size and type of casting to be produced, and finally the metal flows through the filler means 16, 17, 18 preventing the passage of slag and oxides into the mould impression 19.

Then, the molten metal is kept under pressure until it has solidified sufficiently.

Finally, as the pressure in the furnace is released, the metal contained in the distribution chamber 4, 5 and in the lower portions or secltions of inlets 10, 11 and 12 flows back to the furnace.

One advantage characterising this distribution chamber arrangement is that this chamber is safely prevented from being heated while protecting the lower mould impression 7 against overheating.

The provision of a plurality of metal inlets such as 10, 11 and 12 is advantageous not only because the mould filling rate can be adapted to the specific type of casting but also because it affords a shorter solidification time since the heat, instead of being concentrated in a single inlet passage, is distributed among such plurality of feed metal inlets, thus reducing the possibility of overheating. Consequently, the casting quality is improved considerably.

The cooling means 26, 27, 28 and 29 provided in the lower mould impression 7 permit a programmed or predetermined cooling of this mould portion, thus further reducing the solidification time and accelerating the stripping of the castings. Therefore, higher production rates per mould impression than those afforded up to now can be achieved.

Another important feature characterizing this invention is that the inner space of distribution chamber 4, 5 is easily accessible for possible maintenance and repair operations, notably for cleaning and lining operations.

To this end the fastening means such as 22 permit of opening the distribution chamber 4, 5 after releasing the eyebolt 24 for disengaging the lower mould portion 6 and the upper chamber portion 5 from the lower chamber portion 4.

Thus, the upper chamber portion 5 and the lower mould portion 7 are still fastened through the means 22 to the upper mould portion 23. Therefore, the distribution chamber can be opened when normally opening the machine.

It is thus clear that the maintenance of distribution chamber 4, 5 is much facilitated even during the casting operation, if need be.

Another device shown diagramatically in FIG. 1 permits of opening and closing the chamber 4, 5. In this case, the members 22 and 24 are disposed with and means, for example, guide members and cylinder actuators, such as 25, are provided for opening and closing the distribution chamber 4, 5 after each injection step or whenever this is required.

The above disclosure refers to the structure and operation of a single-impression mould, but it will readily occur to those conversant with the art that this casting arrangement is particularly adapted for casting pieces in a mould comprising 2, 3, and 4 impressions by simply adapting the surface of the distribution chamber thereto.

FIG. 2 illustrates diagrammatically by way of example a typical moulding arrangement for casting light-alloy automobile wheels, the assembly being shown in its operating or casting condition.

The description and mode of operation of this specific form of embodiment are identical with the case shown in FIG. 1 as far as the distribution chamber and the feed metal inlets are concerned; in this example five inlets are provided, of which a central inlet 11 and four peripheral inlets, disposed along the wheel rim, such as 10 and 12, which are diametrally opposed by pairs. Thus, any overheating of the mould impressions and also of the feed metal inlets is safely avoided.

The upper mould portion comprises, two, three or four sections or segments such as 33 and 35, and a top central section 34 for the inner cavity of the wheel 19.

Cooling means 30, 31 and 32 are provied in said central section 34 and also in said peripheral segments 33 and 35 at the level, and in close vicinity of, the metal inlets, so that these inlets can be cooled rapidly when the casting has solidified completely. This arrangement permits of reducing the inlet solidification time, so that castings of better quality can be produced at a higher production rate, in addition to the improvement resulting from the use of several feed metal inlets, which are five in number in this example.

The number of castings produced simultaneously per mould may be two or four, the only limit being set by the dimensions of the press plate available, especially in the case of such bulky castings as automobile wheels as referred to in this example.

FIG. 3 illutrates another typical application of the present invention to the casting of light-alloy cylinder-heads of automobile engines, the assembly being also shown in its casting condition.

The description and operation are identical with those concerning the embodiment of FIG. 1, as far as the distribution chamber and the feed metal inlets are concerned.

The feed metal inlets are located beneath the fastening bosses. Their number is 4, 8, 10, 12 or 14, according to the type of cylinder-head (i.e. as the engine concerned comprises 1, 2 . . . 6 cylinders).

The relatively great number of feed metal inlets keeps the maximum temperature of the diecasting mould within reasonable limits, thus affording a higher casting or production rate. Moreover, since these inlets are located just beneath the bosses provided on the cylinder-head for securing it to the cylinder block, high-quality castings can be obtained through the provision of a complete range of adequate risers disposed above these bosses.

Also in this case, the number of mould impression depends on the size of the cylinder-head. This number may range from two impressions per mould in the case of relatively large cylinder-heads (4 to 6 cylinder-engines) to eight impressions per mould in the case of single-cylinder heads, within the limits, of course, permitted by the press plate dimensions.

The low injection pressure inherent to the low-pressure casting technique enables the press and the mould structure to support the large areas required for the type of castings contemplated in the field of the present invention.

Although specific forms of embodiment of the invention have been described hereinabove and illustrated in the accompanying drawing, it will readily occur to those skilled in the art that many modifications and changes may be brought thereto without departing from the scope of the invention as set forth in the appended claims.

We claim:

1. An improved automatic low-pressure diecasting machine of the type having separable upper and lower mould portions wherein molten metal is forced by gaseous pressure into the casting cavity, the improvement comprising:

a plurality of feed inlets arranged substantially vertically through the bottom of said lower mould portion and opening into the casting cavity, and a separable heat-insulated distribution chamber formed of an upper and lower portion and being thermally insulated from said lower mould portion said distribution chamber having an inlet port and a plurality of outlet ports arranged to communicate with said feed inlets in said lower mould portion, said distribution chamber portions also having bosses extending therethrough to permit the mutual bearing engagement of said chamber portions, said bosses having bores axially aligned and extending therethrough, said bores communicating with an axially aligned bore in said lower mould portion and and ejector rod extending through said bores in said bosses and through said bore in said lower mould portion into said casting cavity for removing the casting from the cavity.

2. Automatic low-pressure diecasting machine according to claim 1, wherein the upper portion of the heat-insulated distribution chamber is fastened to the lower mould portion (of the mould) to permit the joint upward movement thereof.

3. Automatic low-pressure diecasting machine according to claim 2, wherein the upper portion of said distribution chamber is thermally insulated from the lower portion of said mould.

* * * * *